United States Patent [19]

Sherman

[11] 4,227,172

[45] Oct. 7, 1980

[54] TWO DIGIT RESISTANCE DECADE BOX

[76] Inventor: Robert E. Sherman, 2421 Sheridan Ave. South, Minneapolis, Minn. 55405

[21] Appl. No.: 5,986

[22] Filed: Jan. 24, 1979

Related U.S. Application Data

[63] Continuation of Ser. No. 833,870, Sep. 16, 1977, abandoned.

[51] Int. Cl.[3] ..... H01C 10/18

[52] U.S. Cl. ..... 338/123; 338/128

[58] Field of Search ..... 338/122, 123, 128, 129, 338/76, 77; 323/94 R

[56] References Cited

U.S. PATENT DOCUMENTS

| | | | |
|---|---|---|---|
| 3,025,485 | 3/1962 | Solow | 338/123 X |
| 3,101,465 | 8/1963 | Luger | 338/128 |
| 3,252,080 | 5/1966 | Newbold et al. | 323/94 R X |
| 3,373,392 | 3/1968 | Julie | 338/77 |

FOREIGN PATENT DOCUMENTS

| | | | |
|---|---|---|---|
| 610282 | 3/1935 | Fed. Rep. of Germany | 338/123 |
| 844757 | 7/1952 | Fed. Rep. of Germany | 338/123 |
| 534251 | 3/1941 | United Kingdom | 338/123 |

*Primary Examiner*—C. L. Albritton

[57] ABSTRACT

The device of this disclosure, hereafter referred to as a "two digit resistance decade box," is a new design of resistance decade box that offers two digit setting accuracy, ease of setting, and improved economy of components. The specifications include a comparison of performance and fabrication economy with the simple resistor substitution box and the conventional resistance decade box. A circuit diagram of the device is presented and explained.

2 Claims, 5 Drawing Figures

TWO DIGIT RESISTANCE DECADE BOX

APPLICATION AND RELATED DEVICES

This application is a continuation of Ser. No. 833,870, filed Sept. 16, 1977, now abandoned, entitled "Two Digit Resistance Decade Box," and in the name of Robert Edward Sherman, and the benefit of the earlier filing date is claimed.

In the design or repair of electronic circuits the technician may desire the temporary use of a resistor of some specific value. The desired value may range from an ohm or less to perhaps several million ohms. Two types of devices are currently manufactured to provide for this need, a "simple resistor substitution box," and a "resistance decade box."

The simple resistor substitution box typically consists of twenty to forty different resistors wired to one or two rotary switches in a manner that permits the user to select that one resistor with a value closest to the resistance he desires. The chief deficiency of the simple resistor substitution box is that in order to cover a range of, say, one ohm to one million ohms with fewer than forty different resistance values, the values must increase in steps averaging more than forty percent of the previous value.

The second currently manufactured device, the conventional resistance decade box, utilizes the principle that the resistance of a network of resistors connected in series is the sum of the individual resistance values. The conventional resistance decade box consists of a series of single pole ten position rotary switches which allow the user to switch into a series circuit from one to nine (or none, a "short circuit") one ohm resistors, from one to nine ten ohm resistors, and so on for hundred, thousand, ten thousand, and hundred thousand ohm resistors. The chief disadvantage of the conventional resistance decade box is that it requires a separate rotary switch and nine resistors for every factor of ten (or "decade") covered. As many as all six of the switches in a device covering one to 999,999 ohms may have to be reset to move from one value to another.

Prior art includes many variations on the decade box concept embodying various special concerns; e.g., minimizing and controlling stray capacitance (German, #610,282), reducing the number of resistors required in construction (German, #844,757), reducing the number of switch dials required (British, #534,251), reducing contact resistance (U.S. Pat. No. 3,025,485), and suppressing leakage resistance (U.S. Pat. No. 3,373,392). The device of this disclosure offers a new combination of features distinctive from and in ways superior to prior art.

BRIEF SUMMARY OF THE INVENTION

The invention of this disclosure is a new design of resistance decade box which requires only four resistors to form each decade (or factor of ten) of resistance values covered, allows the operator to set the two most significant digits of the resistance value desired by the simple adjustment of two conventional ten position rotary switches (called "digit setting switches"), and then allows the operator to set the number of zeros to follow the two set digits by the simple rotation of a third rotary switch (called the "tens-multiplier switch"). This method of setting a resistance value may prove more convenient in the usual technician applications than the method required in the conventional decade box.

It is a principal object of this invention to incorporate in a practical construction the convenience of the tens-multiplier function, familiar in much related electronic test equipment, into the manner of setting the resistance of a resistance decade box.

It is a further object of this invention to make practical the reduction of the number of resistors required to form a decade of resistance values from the current general practice of nine to the theoretical minimum of four, while retaining the simplicity of setting a digit of a desired resistance value by simple rotation of a single ten position rotary switch.

It is a further object of this invention to permit a wide range of resistance values to be obtainable to a precision of the two most significant digits.

It is a further object of this invention to require only three switches, knobs, and dials in a decade box covering six decades of resistance values.

Lesser objects of the invention will become apparent.

R1=5 ohms, R2, R3, R4=2 ohms
R5=50 ohms, R6, R7, R8=20 ohms
R9=500 ohms, R10, R11, R12=200 ohms
R13=5K ohms, R14, R15, R16=2K ohms
R17=50K ohms, R18, R19, R20=20K ohms
R21=500K ohms, R22, R23, R24=200K ohms.

S1 and S2 are identical switches; each has three poles (the central contact on each of the wafers a, b, and c) which are simultaneously set to any one of ten positions by rotation of a common shaft (indicated by the dotted line). Moving clockwise from the break in the external ring of contacts on these wafers, the positions represent the consecutive digit settings "0", "1," "2,"..., "9." S1 is shown set to "2" and S2 is shown set to "7."

S3 is an eight pole five position switch, shown with two poles mounted on each of four wafers (a, b, c, and d) in such a manner that all poles are set simultaneously to any one of five positions by rotation of a common shaft. S3 connects the correct set of four resistors to S1 (and another set to S2) for the decades of resistance values that are required to be formed. Moving clockwise from the break in the external ring of contacts on the wafers of S3 the positions represent "no zeros," "one zero," "two zeros," "three zeros," and "four zeros." It is shown rotated to the "three zeros" position, so the resulting resistance between P1 and P2 is 27,000 ohms. S3 should be a non-shorting type switch.

Figure 1:
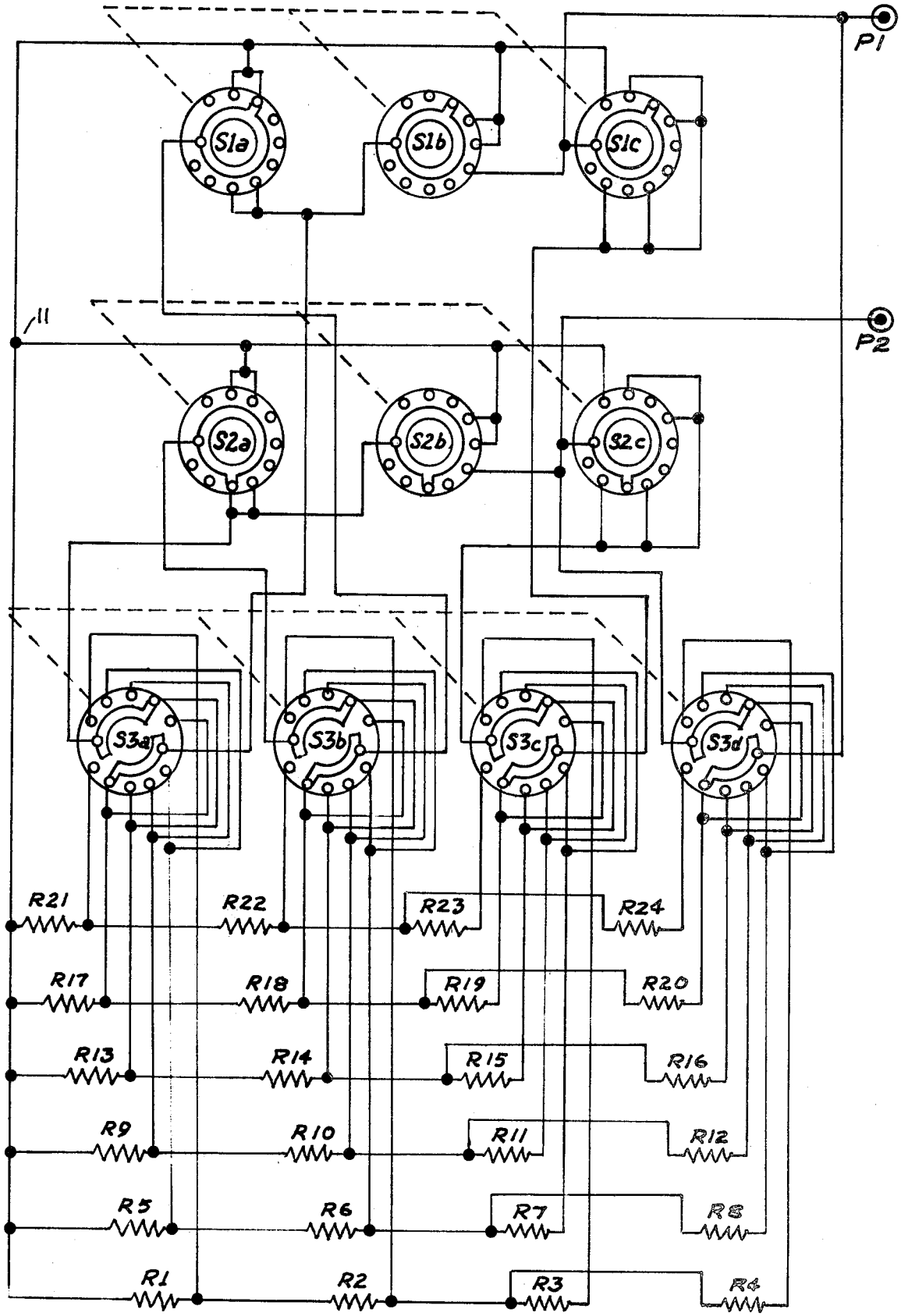
FIG. 1 is a conventional electrical schematic of the invention in the construction contemplated by the inventor. It shows two rotary digit-setting switches (S1 and S2), and their connection through the tens-multiplier switch (S3) to selected networks of four resistors. There are twenty-four resistors in all, falling in six groups of four. The specific values are.
Figure 2:
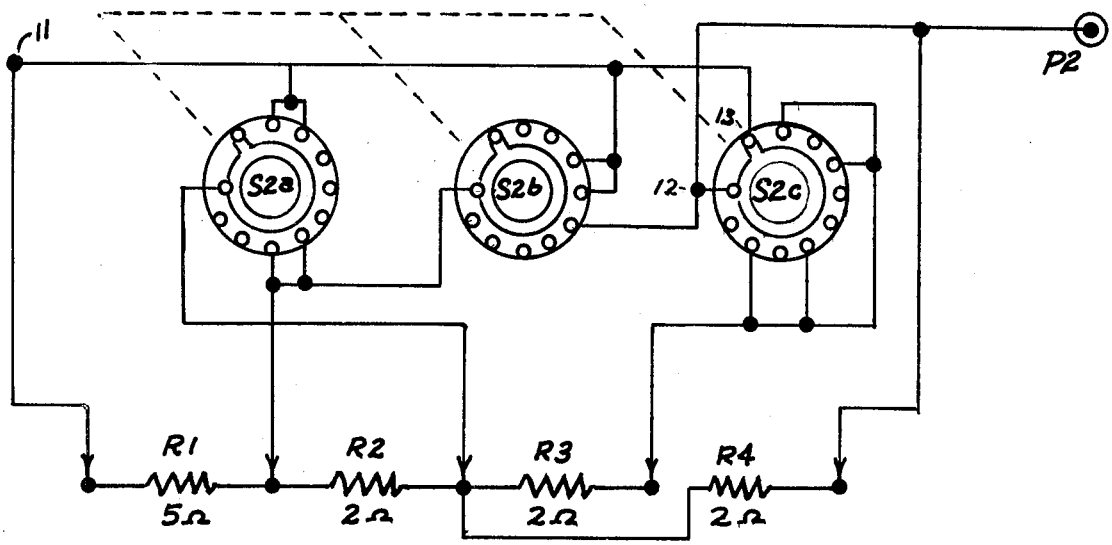

FIG. 2 is a section of FIG. 1 showing a digit setting switch in isolation and as it would be connected to a network of four resistors by the tens-multiplier switch (S3 of FIG. 1), but with the intervening switching circuitry of S3 ommitted to make the digit setting switching function clearer. The specific network of four resistors supplied to S2 would, of course, be determined by the position of S3.

Figure 3A:
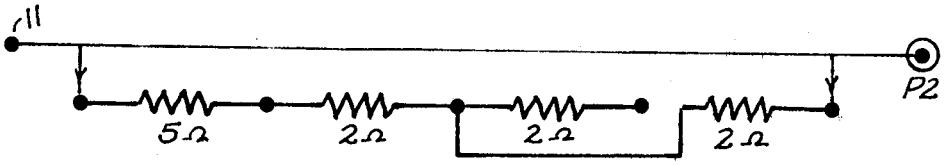
Figure 3B:
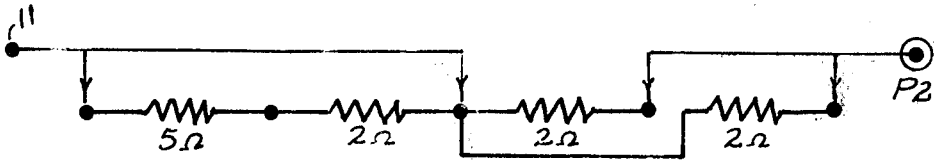
Figure 3C:
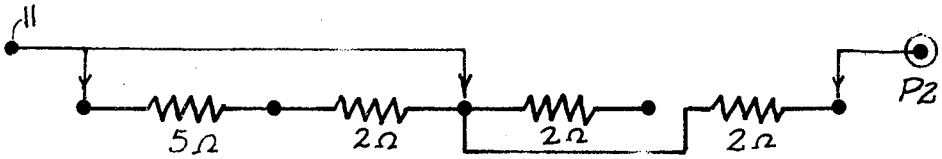

FIG. 3A shows the equivalent electrical circuit of S2 in its "0" position, FIG. 3B the circuit of S2 in its "1"

position, and FIG. 3C the circuit of S2 in its "2" position.

DETAILED DESCRIPTION AND SPECIFICATION OF THE INVENTION

The invention of this disclosure is an improved or novel design of resistance decade box intended for use in general electronic technician work. Once the basic innovative design features are understood, actual construction detail may vary considerably, but FIG. 1 presents an electrical schematic of the design most favored by the inventor. As indicated, it is composed of three rotary switches (S1, S2, and S3), twenty-four resistors (R1, R2, R3, . . . , R24), two terminal posts (P1 and P2), and interconnecting wires. Normally resistors would be 1% precision or better, and of a wattage adequate for the intended load (typically 1 watt). As contemplated by the inventor, the device would be housed in a small box (say, 3" high, 6" wide, and 4" deep), and assembled with suitable knobs, dial faces, and hardware.

The overall purpose of the device is to provide a desired electrical resistance between the two terminal posts P1 and P2 (of FIG. 1). This is done by setting the digit setting switches S1 and S2 to respectively the first and second most significant digits of the desired resistance, and the tens-multiplier switch S3 to the number of zeros to follow these two significant digits. This mode of operation is different from prior art which usually requires that each digit setting switch apply to a single unchangeable decade of resistance values (e.g., the "ones" decade, or the "tens" decade, etc.), and there is no provision for a "tens-multiplier" switch such as S3 of FIG. 1 at all.

The device of this disclosure utilizes the well known principles that the resistance of a set of resistors wired in series is the sum of the resistances of the individual resistors, and also the fact that the resistance of two resistors wired in parallel is given by the formula:

$$R1 \cdot R2/(R1+R2).$$

To carry the explanation of this invention further let us clarify the usage of certain terms. First, a $10^k$ decade of resistance values refers to the set of ten resistance values 0, 1, 2, 3, 4, 5, 6, 7, 8, and 9 times $10^k$ ohms, where k may be any chosen integer (or zero). A $10^k$ resistance decade module refers to an electrical device with two identified terminal points between which the $10^k$ decade of resistance values can be formed by the setting of a switch. In our construction such a decade module will be comprised of (a) a network of resistors called the $10^k$ resistance network, connected to (b) a ten position switch which we shall call a digit setting switch, whose consecutive positions will establish the $10^k$ decade of resistance values between two identified terminals located on the switch. The digit setting switch may be a conventional single pole, a conventional multiple pole, or of special construction, depending upon the design of the decade module. The digit setting switch is also understood to include such permanently wired interconnections on the body of the switch as may be required to allow it to perform the interconnections needed on the $10^k$ resistance network to form the $10^k$ decade of resistance values. It is clear that the design of the digit setting switch is dependent upon the choice of the resistance network, and that only certain resistance networks are feasible for use in a resistance decade module.

It happens that at least four resistors are required to form a feasible resistance network for a decade module. For any $10^k$ decade of resistance values there is a finite number of such feasible sets of four resistors. Examples include (in $10^k$ ohm units): (1, 2, 3, 3), (1, 2, 4, 8), (2, 2, 2, 5), and even (2, 3, 6, 252). The number of different non-feasible sets of four resistors is, of course, limitless.

A resistance decade box is typically constructed of a $10^0$, a $10^1$, a $10^2$, a $10^3$, a $10^4$, and a $10^5$ resistance decade module, the terminal points of which are all wired in series. The resistance formed across the extreme terminals in this construction is thus the sum of the resistances formed in each of the resistance decade modules. The setting of these modules thus include in the circuit respectively the number of "ones", "tens, " "hundreds," and so on, into the total resistance value. The operator is thereby able to set, by means of six rotary switches, any desired integer resistance from (say) one to 999,999 ohms. Of course the actual value of resistance achieved would be only as precise as the precision of the component resistors—normally in the vicinity of 1% tolerance, though much finer tolerances are sometimes used.

At this point we may observe that the schematic of FIG. 2 represents a 10° resistance decade module. As the switch (S2 in FIG. 2) is moved through its ten positions it will form the 10° decade of resistance values between two identifiable points on the switch, noted on the schematic as points 12 and 13. It is also clear that if the resistors R1 through R4 were replaced by resistors with $10^k$ times their resistance, then the $10^k$ decard of resistance values would be formed between points 12 and 13.

Referring now to FIG. 1, it can be seen that S1 and S2 are both digit setting switches, each with the same circuitry as that of S2 in FIG. 2. The terminal points on these digit setting switches are wired in series with the extreme terminals connected to P1 and P2. They thereby form two resistance decade modules wired in series between the terminal posts P1 and P2. What is different is that they are not connected to a fixed network of resistors, rather the consecutive five positions of S3 connect S1 respectively to $\mathbf{10^1}$, $\mathbf{10^2}$, $\mathbf{10^3}$, $\mathbf{10^4}$, and $\mathbf{10^5}$ resistance networks, and simultaneously connect S2 respectively to $\mathbf{10^0}$, $\mathbf{10^1}$, $\mathbf{10^2}$, $\mathbf{10^3}$ and $\mathbf{10^4}$ resistance networks. Thus when S3 is in its first position S1 is connected to a $\mathbf{10^1}$ resistance network, forming thereby a $\mathbf{10^1}$ resistance decade module, and simultaneously S2 is connected to a $\mathbf{10^0}$ resistance network, forming thereby a $\mathbf{10^0}$ resistance decade module. Since these two modules are connected in series, their setting can form all integer resistance values from zero to 99 ohms. Similarly, if S3 is advanced to its next position, S1 becomes connected to a $10^2$ resistance network, forming thereby a $10^2$ resistance decade module, and S2 becomes connected to the $10^1$ resistance network, forming thereby a $10^1$ resistance decade module. The total resistance of these two modules connected in series is consequently increased by a factor of ten. The same increase holds for every advance of the position of the switch S3, hence it functions as a "tens-multiplier."

In the device of this disclosure the "tens-multiplier" strategy depends upon switching four connections from each digit setting switch to points in appropriate networks of four resistors. (It should be noted that each resistance network has five terminals, but the fact that the design requires only two decade modules to be in the circuit at any one time, allows all resistance networks to retain one point in common (labeled 11 on FIG. 1) and only four points need be switched. The use of a common point for this advantage, but not the switching circuit, may have been anticipated by Solow, Ser. No. 3,025,485). In principle, the "tens-multiplier" concept could be applied in the conventional resistance decade box which utilizes a network of nine resistors for each decade module. However this would be much less practical, for such an application would require an eighteen pole five position "tens-multiplier" switch, more than double the size of the switch required in the device of this disclosure.

In sum, the device of this disclosure functions as a resistance decade box, requires only three switches to be set to obtain to two digit accuracy any resistance in the range one to 990,000 ohms; incorporates the familiar setting simplicity of the tens-multiplier concept, and requires only four resistors instead of the conventional nine for each resistance decade module, while retaining the advantage of setting a digit with a single switch.

The heart of the invention lies in the interacting and mutually reenforcing effects of several novel design elements. First it is recognized that selection of a resistance value to a precision of two significant digits is adequate in a great number of applications. If only two significant digits need be set, the obvious complement is a switch to set the number of zeros to follow these significant digits (the "tens-multiplier" switch). The incorporation of a tens-multiplier switch in the design means that only two digit setting switches instead of six are required, but if conventional decade modules are used, the tens-multiplier switch would have to be a very complex eighteen pole five position switch. But since we will need only two digit setting switches, we can afford to make them more complex than the single pole ten position switches of the conventional decade box design. With more complex digit setting switches (e.g. S2 in FIG. 2), we discover that we can make a decade module using networks of only four resistors. If four resistor networks are used in the two digit design, we further discover that only four points of the resistance networks need be switched, and this can be done with a more practical eight pole five position switch (e.g. S3 of FIG. 1). The overall result is an economy of components combined with plausibly greater ease of use.

The circuitry shown is by no means unique. The presented circuitry is the best design contemplated by the inventor. Some factors involved in this choice are:

(1) The complexity of the switching required. It is undesireable if the switches must be custom designed, or require more than the three wafers of the presented design (four wafers for the tens-multiplier).

(2) It is desireable to utilize resistors in configurations that distribute the load so that capacity for power dissipation is greater. Such configurations also tend to do a better job of averaging out individual resistor errors, reducing the percentage error of the total set resistance.

(3) It is a construction convenience to require a fewer number of different values of resistors. Reviewing all feasible combinations of four resistor networks reveals that two different values is the minimum possible in a feasible four resistor $10^k$ resistor network.

I claim:

1. A resistance decade box for applications where the adjustment of a resistance value to a precision of two significant digits is sufficient, wherein the improvement consists of the combination of circuit elements given below which acting together have the effect of incorporating a tens-multiplier into the method of setting a desired resistance value as well as reducing the number of components required for the manufacture of the device; these circuit elements and their manner of combination are:

A first three-pole ten position digit-setting switch including interconnections among pole and pole position terminals on the switch forming five electrically distinct junctions which, when connected to a chosen feasible $10^k$ resistance network, is able, by selection of its ten positions, to form the $10^k$ decade of resistance values between two of the said junctions on the switch; said first digit-setting switch is serially connected with a second identically wired three-pole ten position digit-setting switch, and the extremes of the serial connection are connected to terminal posts provided for connection to external circuits; a sequence of six groups of four resistors, each group connected in a network configuration with five electrically distinct connection points, one point from each of the six networks connected together with a common junction of the first and second digit-setting switches, and the kth network of the sequence forming a $10^{k-1}$ resistance network capable of being interconnected to form the $10^{k-1}$ decade of resistance values by either the first or the second digit-setting switch when the remaining four points of the network are connected to the other four junction points on either the first or the second digit-setting switch; an eight-pole five position tens-multiplier switch whose consecutive positions connect four junction points of the first digit-setting switch to four respective connection points in the $10^1$, $10^2$, $10^3$, $10^4$, or $10^5$ resistance networks and simultaneously connect four junction points of the second digit-setting switch to four respective connection points in the $10^0$, $10^1$, $10^2$, $10^3$, or $10^4$ resistance networks; the five consecutive positions of the tens-multiplier switch thereby respectively connect the first and second digit-setting switches as a $10^1$ resistance decade module in series with a $10^0$ resistance decade module, a $10^2$ resistance decade module in series with a $10^1$ resistance decade module, a $10^3$ resistance decade module in series with a $10^2$ resistance decade module, a $10^4$ resistance decade module in series with a $10^3$ resistance decade module, or a $10^5$ resistance decade module in series with a $10^4$ resistance decade module, which has the effect of multiplying the value of the decade box resistance by 10 for each advance of the tens-multiplier switch position.

2. A resistance decade box for applications where the adjustment of a resistance value to a precision of two significant digits is sufficient, wherein the improvement consists of the combination of circuit elements given below which acting together have the effect of incorporating a tens-multiplier into the method of setting a desired resistance value as well as reducing the number of components required for the manufacture of the device; the circuit elements are:

(a) Two terminal posts for connection to external circuits;

(b) A first digit-setting switch, consisting of a three-pole ten position switch with interconnections among the pole and switch position terminals resulting in five electrically distinct junctions, a first junction formed by the connection of the terminal of the first pole to the terminal of the sixth position of the second pole; a second junction formed by the connection of the terminal of the second position of the first pole to the terminals of the fourth, seventh, and ninth positions of the first pole; a third junction consisting of the terminal of the third pole; a fourth junction formed by the connection of the terminal of the second pole to the terminals of the seventh and eighth positions of the third pole; a fifth junction formed by the connection of the terminal of the first position of the first pole to the terminals of the fourth and fifth positions of the second pole and the second and third positions of the third pole;

(c) A second digit-setting switch identical to the first digit-setting switch;

(d) A tens-multiplier switch, consisting of an eight-pole five position switch with the pole position terminals of the first and second poles interconnected so that the terminal of the first position of the first pole is connected to the terminal of the second position of the second pole, and the terminal of the second position of the first pole is connected to the terminal of the third position of the second pole, and the terminal of the third position of the first pole is connected to the terminal of the fourth position of the second pole, and the terminal of the fourth position of the first pole is connected to the terminal of the fifth position of the second pole; the position terminals of the third and fourth poles, the fifth and sixth poles, and the seventh and eighth poles have identical pairwise interconnections as those on the position terminals of the first and second poles;

(e) Six groups of four resistors each, the first group consisting of a five ohm resistor, a first two ohm resistor, a second two ohm resistor, and a third two ohm resistor, said first group of four resistors connected together into a first resistance network with five electrically distinct connection points; the first connection point consisting of one terminal of the five ohm resistor; the second connection point consisting of the other terminal of the said five ohm resistor connected with one terminal of the first two ohm resistor; the third connection point consisting of the other terminal of the said first two ohm resistor connected with one terminal of the second two ohm resistor and one terminal of the third two ohm resistor; the fourth connection point consisting of the other terminal of the said second two ohm resistor; the fifth connection point consisting of the other terminal of the said third two ohm resistor; the second, third, fourth, fifth, and sixth groups of four resistors are each connected respectively into a second, third, fourth, fifth, and sixth resistance network exactly as the first group of four resistors, the sole difference being that the resistors comprising the second, third, fourth, fifth, and sixth resistance networks have respectively 10, 100, 1,000, 10,000, and 100,000 times the values of the resistors comprising the first resistance network;

the elements defined in (a), (b), (c), (d), and (e) above are interconnected as follows: the first connection points of all six resistance networks defined in (e) are all connected in common with the fifth junctions of both digit-setting switches defined in (b) and (c); the rest of the connection points of the resistance networks are connected to pole position terminals of the tens-multiplier switch defined in (d) as follows: connection points two, three, four, and five of the first resistance network are connected respectively to the terminals of the first pole positions of eighth, sixth, fourth, and second poles; connection points two, three, four, and five of the second resistance network are connected respectively to the terminals of the first pole positions of the seventh, fifth, third, and first poles; connection points two, three, four, and five of the third resistance network are connected respectively to the terminals of the second pole positions of the seventh, fifth, third, and first poles; connection points two, three, four, and five of the fourth resistance network are connected respectively to the terminals of the third pole positions of the seventh, fifth, third, and first poles; connection points two, three, four, and five of the fifth resistance network are connected respectively to the terminals of the fourth pole positions of the seventh, fifth, third, and first poles; connection points two, three, four, and five of the sixth resistance network are connected respectively to the terminals of the fifth pole positions of the seventh, fifth, third, and first poles;

the first, second, third, and fourth junctions of the first digit-setting switch defined in (b) are connected respectively to the pole terminals of the first, third, fifth, and seventh poles of the tens-multiplier switch defined in (d); the first, second, third, and fourth junctions of the second digit-setting switch defined in (c) are connected respectively to the pole terminals of the second, fourth, sixth, and eighth poles of the tens-multiplier switch defined in (d);

a first terminal post for connection to external circuits defined in (a) is connected to the first junction of the first digit-setting switch defined in (b); a second terminal post for connection to external circuits is connected to the first junction of the second digit-setting switch; the connection between the fifth junctions of the first and second digit-setting switches result in a serial connection of the two digit-setting switches between the two terminal posts;

with all of the preceeding elements so connected, and with the tens-multiplier switch in its first position, the rotation of the first digit-setting switch to its consecutive positions connect the second network of resistors in a sequence of configurations which create the sequence of resistance values 0, 10, 20, 30, 40, 50, 60, 70, 80, and 90 ohms between the first terminal post for connection to external circuits and the fifth junction defined in (b); the rotation of the second digit-setting switch through its ten positions connect the first network of resistors in a sequence of configurations which create the sequence of resistance values 0, 1, 2, 3, 4, 5, 6, 7, 8, and 9 ohms between the fifth junction defined in (b) and the second terminal post for connection to external circuits; the setting of the first and second digit-setting switches are thereby able to form every integer value of resistance between zero and ninety-nine ohms, and said resistance appears across the two terminal posts for connection to external circuits; furthermore, every advance of the position of the tens-multiplier switch increases the value of the resistors in the resistance networks connected to the first and second digit-setting switches by a factor of 10, thereby increasing the value of resistance appearing across the terminal post for connection to external circuits by a factor of ten.

* * * * *